US005331175A

United States Patent [19]

Morris et al.

[11] Patent Number: 5,331,175

[45] Date of Patent: Jul. 19, 1994

[54] STRAND BREAKAGE DETECTION SYSTEM FOR USE WITH A PLURALITY OF STRANDS BEING FED IN UNISON ALONG A ROTATING CIRCULAR ARRAY OF FEED PATHS

[75] Inventors: Paul H. Morris; Joseph L. Krause, Jr., both of Lincoln, Nebr.

[73] Assignee: The Goodyear Tire & Rubber Company, Akron, Ohio

[21] Appl. No.: 995,634

[22] Filed: Dec. 18, 1992

[51] Int. Cl.[5] ..... G01N 21/86; G01V 9/04

[52] U.S. Cl. ..... 250/561; 250/571; 356/429

[58] Field of Search ..... 250/561, 562, 571, 572; 356/238, 239, 429, 430; 28/185; 57/81, 61

[56] References Cited

U.S. PATENT DOCUMENTS

| | | | |
|---|---|---|---|
| 1,316,929 | 9/1919 | Taylor | 66/158 |
| 2,233,483 | 3/1941 | Metcalf | 250/561 |
| 2,570,381 | 10/1951 | Roughsedge et al. | 66/163 |
| 2,651,275 | 9/1953 | Moore | 66/163 |
| 3,345,812 | 10/1967 | Pickering | 250/561 |
| 3,628,030 | 12/1971 | Fertig et al. | 250/572 |
| 3,800,162 | 3/1974 | Lueck et al. | 250/571 |
| 4,100,425 | 7/1978 | Ohsawa | 250/561 |
| 4,169,981 | 10/1979 | White et al. | 250/561 |
| 4,410,803 | 10/1983 | Henze | 250/561 |
| 4,608,496 | 8/1986 | Rosen | 250/561 |
| 4,976,018 | 12/1990 | Bollen | 57/81 |
| 5,206,709 | 4/1993 | Schewe et al. | 250/561 |

*Primary Examiner*—David C. Nelms
*Assistant Examiner*—Stephone B. Allen
*Attorney, Agent, or Firm*—T. P. Lewandowski

[57] ABSTRACT

A system for sensing breakage of one or more of a plurality of strands of material that are being fed in unison along a circular array of separate feed paths while the array of feed paths is being rotated about an imaginary axis that extends substantially centrally among the array of feed paths utilizes separate indicator assemblies positioned along each of the separate feed paths, with the indicator assemblies being arranged in a substantially circular array for rotation along a circular path of movement that extends substantially concentrically about the axis of rotation. At least one optical detector is positioned alongside the substantially circular path of movement that is followed by the indicator assemblies as they rotate, whereby, at least once during each revolution, each of the indicator assemblies is caused to move past an optical detector. In the event that any of the indicator assemblies detect breakage of its associated strand, an associated indicator flag is pivoted quickly under the action of an associated biasing device from its normally nested position to an extended position that will be sensed as the flag-extended indicator assembly moves past an optical detector.

26 Claims, 6 Drawing Sheets

STRAND BREAKAGE DETECTION SYSTEM FOR USE WITH A PLURALITY OF STRANDS BEING FED IN UNISON ALONG A ROTATING CIRCULAR ARRAY OF FEED PATHS

BACKGROUND OF THE INVENTION

1. Field of the Invention

The present invention relates generally to a system for rapidly detecting breakage of one or more of a plurality of strands of material that are being fed along an array of separate feed paths while the array of feed paths is being rotated about an imaginary axis that extends substantially centrally among the feed paths. More particularly, the present invention relates to the use of a plurality of strand breakage indicator assemblies that each are associated with a separate one of the feed paths for providing pivotally mounted flag-carrying indicator arms that are counterbalanced to render the arms substantially insensitive to centrifugal force and to changes in speed of rotation, with each of the arms being biased into engagement with a guided reach of an associated strand in a manner that will permit such tautness of the reach as is characteristic of normal feeding of the strand along its associated feed path to hold the associated flag-carrying arm in a "nested" position; however, if the associated strand should break, or if an undesired diminution in tautness of the guided reach of the associated strand is otherwise caused to take place, the associated flag-carrying indicator arm promptly will pivot to an "extended" position wherein it typically will be detected within less than one revolution of the array of feed paths by a stationary detector that monitors a circular path of travel that is followed by "extended" indicator flags.

2. Prior Art

While a variety of strand breakage detection systems have been proposed for use with apparatus that requires the concurrent feeding of a plurality of strands of material along separate feed paths to a workstation or the like, most of these prior proposals are not suited for use with apparatus that requires that a plurality of strands be fed in unison along an array of feed paths while the array is being rotated at relatively high speeds of rotation (e.g., within the range of about 600 to about 1400 revolutions per minute, and sometimes higher).

A significant problem that arises when structures that define arrays of feed paths are rotated at speeds as high as 1400 revolutions per minute is that the components of such structures must be capable not only of withstanding relatively high loadings of centrifugal force, but must also be capable of functioning properly in the presence of such loadings. At 1400 revolutions per minute, a component that is spaced only a few inches from the axis of rotation easily can be subjected to loadings of force that are hundreds of times the weight of the component. In such circumstances, electrical switch components easily can develop malfunctions and/or fail to perform as intended. Likewise, even simple mechanical devices that employ relatively movable parts and that have proven to be highly reliable when used in stationary environments often are found to malfunction and/or fail to perform as intended when subjected to an environment of high speed rotation.

While a number of proposals have been made that attempt to utilize electrical components and circuitry that is installed on rotating structures to provide for the sensing of breakage of one or more strands that are being fed in unison along arrays of feed paths that are defined by such structures, still another problem that typically renders such proposals unsuitable is that, of necessity, they employ some form of commutators to establish requisite electrical connections between the rotating structures and adjacent stationary structures. Such proposals not only characteristically suffer from the drawbacks and shortcomings described above, but also from the problems that typically are associated with the use of commutators. Commutators are subject to wear and often fail to supply with suitable stability the type of uninterrupted electrical contact that needs to be maintained between rotating and stationary structures. Thus, to the extent that the employment of commutators, electrical components and associated circuitry can be avoided on rotating structure that defines a plurality of strand feed paths, it has been deemed desirable to do so.

In commercially available knitting machinery of the type that typically is utilized in the formation of reinforced rubber hose to provide a knitted layer of reinforcing material that extends about an inner layer of the rubber hose, it often is desirable to rotate an assembly known as a "knitter" (i.e., a commercially available unit that employs knitting needles that are moved by a mechanical cam drive system and which needs to be supplied with a plurality of strands of material to be "knitted") at relatively high speeds of rotation together with such structure as defines an array of feed paths that are followed by strands of material that are fed in unison to the knitter. The faster that the knitter and the associated strand feed path defining structure can be rotated while suitably supplying an array of strands of material to the knitter, the greater the length of reinforced hose that can be produced during a given period of time. However, the faster that the strand-feeding structure is rotated, the greater are the centrifugal forces that are imposed on attendant strand breakage sensing components, and, if known types of strand breakage detector devices are employed, the greater is the likelihood that they will be deleteriously affected. A suitably simple, highly reliable strand breakage detection system that is capable of being used in such an environment long has eluded those who are skilled in the art.

SUMMARY OF THE INVENTION

The present invention addresses the foregoing and other needs and drawbacks and of the prior art by providing a novel and improved strand breakage detection system that is characterized by an elegant degree of simplicity while, at the same time, employing an arrangement of components that are highly reliable and designed to function properly even in an environment of relatively high speed rotation such as is encountered in feeding to commercially available knitter apparatus and the like a plurality of strands of material in unison along an array of separate feed paths.

One feature of the strand breakage detection system of the present invention is that it does not require the use of electrical commutators; nor does it call for the installation of electrical components or circuitry on rotating structure where such installations would be subjected to centrifugal force and to forces that result from changes in the speed of rotation. Thus, concerns about shock hazards, circuit damage and/or machine malfunction resulting from failed or malfunctioning electrical components carried on rotating structure are obviated.

Another feature of the strand breakage detection system of the present invention resides in the fact that such relatively movable mechanical components as are mounted on a rotary structure are counterbalanced and suitably configured to aid these components in performing properly throughout long service lives even if subjected quite regularly to relatively high speed rotation. In preferred practice, a plurality of mechanical indicator assemblies are mounted on a rotary structure that rotates about an axis of rotation while feeding a plurality of strands of material along an array of feed; and, the mechanical indicator assemblies interact with a single detector that is mounted on a stationary structure that extends alongside a substantially circular path that is followed by the indicator assemblies during rotation of the rotary structure about the axis of rotation.

Still another feature of the strand breakage detection system of the present invention is that, in preferred practice, only one fast-acting sensing device, preferably a detector of the solid-state type, is used to cooperate with a plurality of mechanical indicator assemblies to provide a quick-acting capability to sense breakage of any of the strands that are fed along an array of separate feed paths that typically are defined, at least in part, by the rotary structure. While a plurality of fast-acting detectors may be arranged in a circle about the rotating structure to provide a "broken strand signal" within substantially less than a full revolution of the rotary structure, unless the rotating structure is rotating quite slowly, or unless it is desired to provide more than one detector as something of a "backup" to assure that strand breakage is detected even if one of the detectors should fail, it will ordinarily suffice to use only a single fast-acting detector.

By the term "fast-acting," what is meant is that the detector has a capability to sense the presence of a passing "extended" indicator flag within slightly less time of being exposed to the presence of the extended indicator flag than will be provided by an extended indicator flag that is being rotated past the detector. Thus, if a rotary structure that mounts a plurality of indicator assemblies is rotating at 60 revolutions per minute (i.e., one revolution per second), it will be readily understood by those who are skilled in the art that a stationary detector will therefore be able to "view" an "extended" indicator flag of a passing indicator assembly for only a fraction of a second—perhaps for as little as 1/30th to 1/60th of a second, for the "extended" indicator flag will be "in view" by the detector for only a fraction of the one second that is required for it to complete one revolution. If the rotary structure that carries the indicator assemblies is rotating at a much higher speed of rotation, for example 1200 revolutions per minute, as will be readily apparent to those who are skilled in the art, the reaction time of the detector will need to be significantly faster (i.e., about 20 times faster) than was required to sense the passage of extended indicator flags that are passing the detector at 60 revolutions per minute.

A very simple type of relatively inexpensive solid-state fast-acting detector preferably is used, namely a fast-acting photocell onto which a beam of light is directed, with the beam being oriented such that it will be interrupted by a passing extended indicator flag so as to cause the photocell to provide a "strand broken signal" as the result of the sensed passage by the detector of an extended indicator flag. Many fast acting optical sensors of the solid-state type are commercially available and can be utilized for the purpose here described, as will be readily understood by those who are skilled in the art.

While a fast-acting, solid-state optical type of commercially available sensor in the form of a fast-acting photocell is the preferred form of sensor to be used in carrying out the practice of the present invention, other types of highly reliable, fast-acting sensors also are commercially available and may be used in place of or to augment the operation of the single fast-acting photocell type of commercially available sensor that is described above.

In preferred practice, the fast-acting sensor or sensors that are arranged about the rotary structure to sense the pivoting of one of the indicator flags to its "extended" position is/are mounted on stationary structure that extends alongside the rotary structure. By this arrangement, the fast-acting sensor or sensors are not subjected to the very substantial forces that can be incurred in an environment of relatively high speed rotation, as has been discussed previously.

In accordance with the most preferred practice of the present invention, a novel and improved system is provided for rapidly sensing breakage of one or more of a plurality of strands of material that are being fed in unison along an array of separate feed paths while the array of feed paths is being rotated at a relatively high speed of between about 600 to about 1400 revolutions per minute about an imaginary axis that extends substantially centrally among the feed paths. Separate indicator assemblies are positioned along each of the separate feed paths and preferably are arranged in a substantially circular array that extends substantially concentrically about the axis of rotation. At least one commercially available fast-acting detector, preferably of the optical type described above, is mounted on stationary structure and is positioned to extend alongside the substantially circular path of movement that is followed by the indicator assemblies as they rotate. By this arrangement, at least once during each revolution, each of the indicator assemblies is caused to move past the detector and will therefore cause the detector to provide a "strand broken signal" within no more time than is required to effect a single revolution of the rotary structure on which the indicator assemblies are mounted. In the event that any of the indicator assemblies detects breakage of its associated strand, an associated indicator flag is pivoted quickly under the action of an associated biasing device from its normally nested position to an extended position that will be sensed as the flag-extended indicator assembly moves past the fast-acting detector.

In preferred practice, the aforedescribed strand breakage indicator flags are carried by pivotally mounted indicator arms that are counterbalanced to prevent their being influenced either by centrifugal force or by changes in the speed of rotation. The indicator assemblies preferably each include a biasing device such as a torsion coil spring to effect biasing of their indicator arms toward their extended positions. In preferred practice, each of the indicator assemblies is provided with a knob to permit the biasing force that is applied to the associated indicator arm to be adjusted. The biasing force applied to each indicator arm should not be such as will cause an engaged strand reach to deviate to any significant degree from the associated feed path, but should be strong enough to cause the associated indicator arm to pivot quite rapidly to its extended position in the event that the engaged strand reach suddenly loses its tautness due to breakage or due to some other manner of strand feeding problem.

In preferred practice, each of the indicator assemblies is provided with a latch that can be used to releasably "hold down" (i.e., releasably retain in a "nested" position) the associated indicator arm and its associated indicator flag. This "latch down" capability is useful both during threading of strands of material along their associated feed paths, and in the event that a lesser than usual number of strands are to be fed (i.e., a lesser number than would be fed if all of the feed paths of the rotary member were put to use), in which case any "unutilized" indicator assemblies need to have their indicator flags "latched down" so that false "strand broken signals" are not generated when the indicator assemblies are rotated about the axis of rotation.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
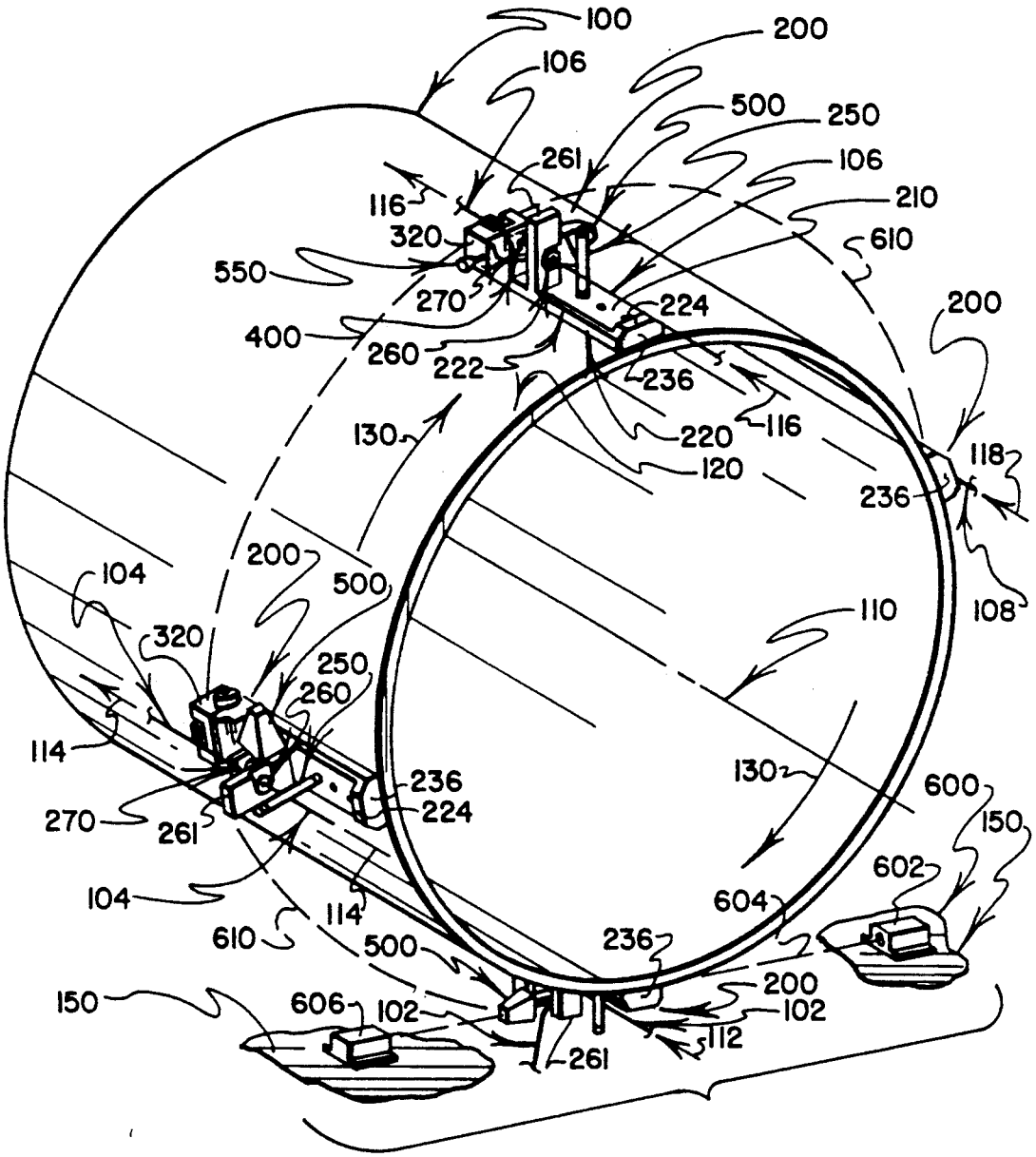
FIG. 1 is a foreshortened perspective view of a rotatable tubular member that has mounted on its circumference a total of four equally spaced strand breakage indicator assemblies, with each of the assemblies being shown extending along a separate one of an array of four feed paths, with strands of material being moved along the feed paths, with the view showing stationary structure that extends beneath the tubular member for mounting a stationary fast-acting detector thereon, with the detector being oriented to monitor a lowermost portion of a circular path along which indicator flags of the indicator assemblies travel when the indicator flags are in their "extended" positions, with the lowermost of the four indicator assemblies being shown with its indicator flag "extended," and with other visible indicator flags being shown in their "nested" positions.

Referring to FIG. 1, a rotary member 100 of generally tubular form is shown extending coaxially about an imaginary axis of rotation 110. The rotary member 100 is connected to suitable stationary support structure (portions of which are indicated by the numeral 150) by interposing suitable commercially available bearings or the like (not shown) between the member 100 and the stationary support structure 150 so that the rotary member 100 is rotatable relative to the stationary support structure 150 about the rotation axis 110 in a clockwise direction that is indicated by arrows 130.

A plurality of identical strand breakage indicator assemblies 200 are mounted about the circumference 120 of the rotary member 100 for rotation therewith along a circular path of movement that is concentric about the axis 110. While a total of four of the indicator assemblies 200 are depicted in FIG. 1 as being mounted on the rotary member 100 at substantially equal spacings about the circumference 120 of the rotary member 100, it will be understood that substantially any desired number of the indicator assemblies 200 may be installed about the circumference 120 of the rotary member 100 for servicing a corresponding number of strands of material that extend along a corresponding number of separate feed paths. Thus, the depiction in FIG. 1 of a total of four indicator assemblies 200 that service a total of four strands of material 102, 104, 106, 108 that extend along a feed path array that consists of a total of four separate feed paths 112, 114, 116, 118 is not to be taken as an indication that features of the present invention are limited to the use of a particular number of the indicator assemblies 200 serving a feed path array that consists of any particular number of separate feed paths.

The indicator assemblies 200 serve the dual purpose of guiding and detecting the proper feeding of the four strands of material 102, 104, 106, 108 along at least portions of the separate feed paths 112, 114, 116, 118. The indicator assemblies 200 are arranged (i.e., "arrayed") to extend in an imaginary circle that is defined by the outer surface 120 (i.e., the circumference) of the rotary member 100, and extend concentrically about the rotation axis 110.

Inasmuch as all four of the indicator assemblies 200 are structurally identical, only one of the indicator assemblies 200 is depicted in drawing views other than the view of FIG. 1. The indicator assembly 200 that is depicted in FIGS. 1–7, 9 and 10 is the indicator assembly 200 that serves the strand 106 which extends along the feed path 116 (i.e., the uppermost of the four indicator assemblies 200 that are depicted in FIG. 1).

Figure 2:
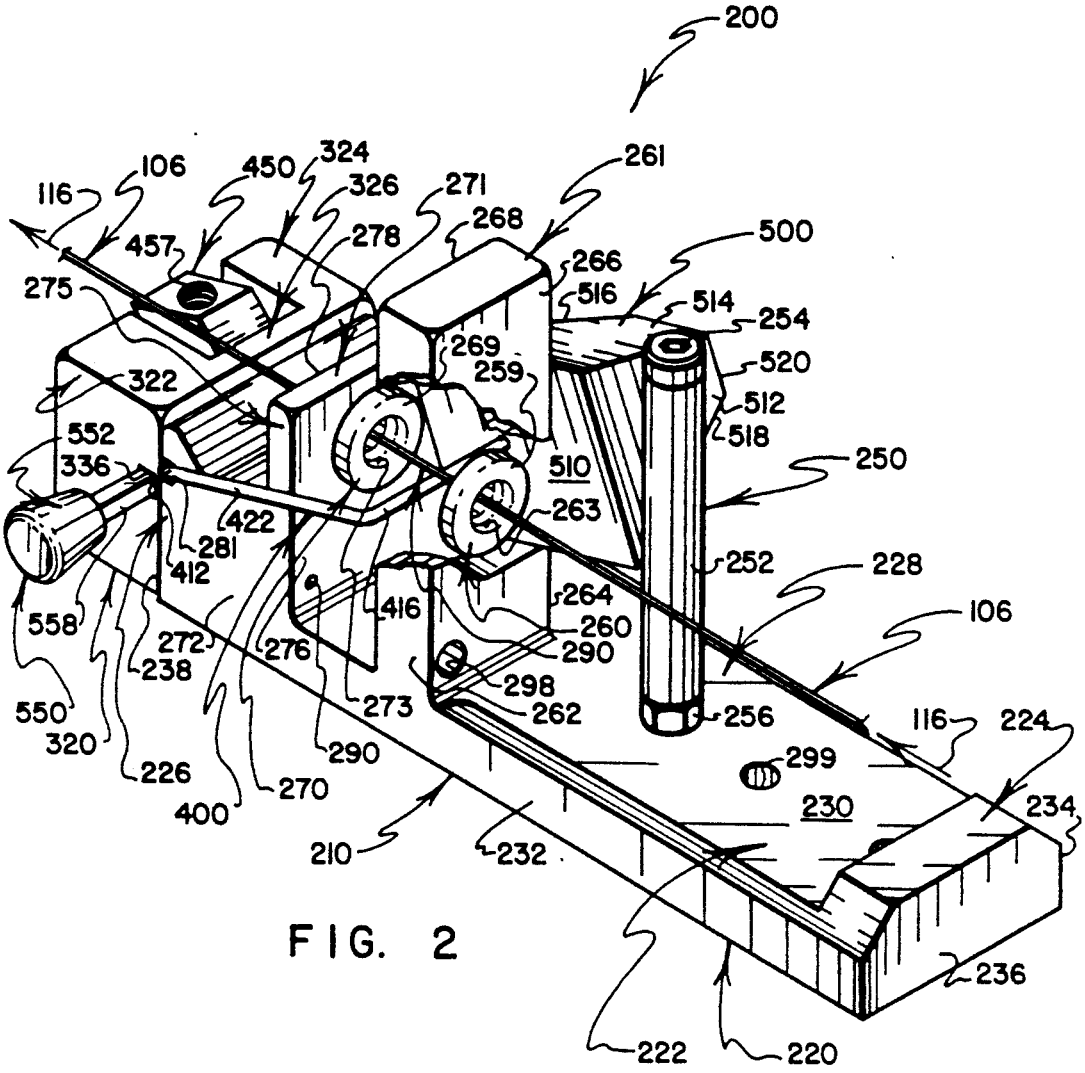
FIG. 2 is a left side perspective view, on an enlarged scale, of the uppermost one of the four strand breakage signal assemblies that are depicted in FIG. 1, with a strand extending therethrough along an associated feed path thereof, with the view showing the indicator arm and the indicator flag of the depicted indicator assembly in "nested" positions that are assumed during normal operation when the associated strand is being held taut and is unbroken, and with portions of the body of the indicator assembly being broken away to permit otherwise hidden features to be seen.
Figure 3:
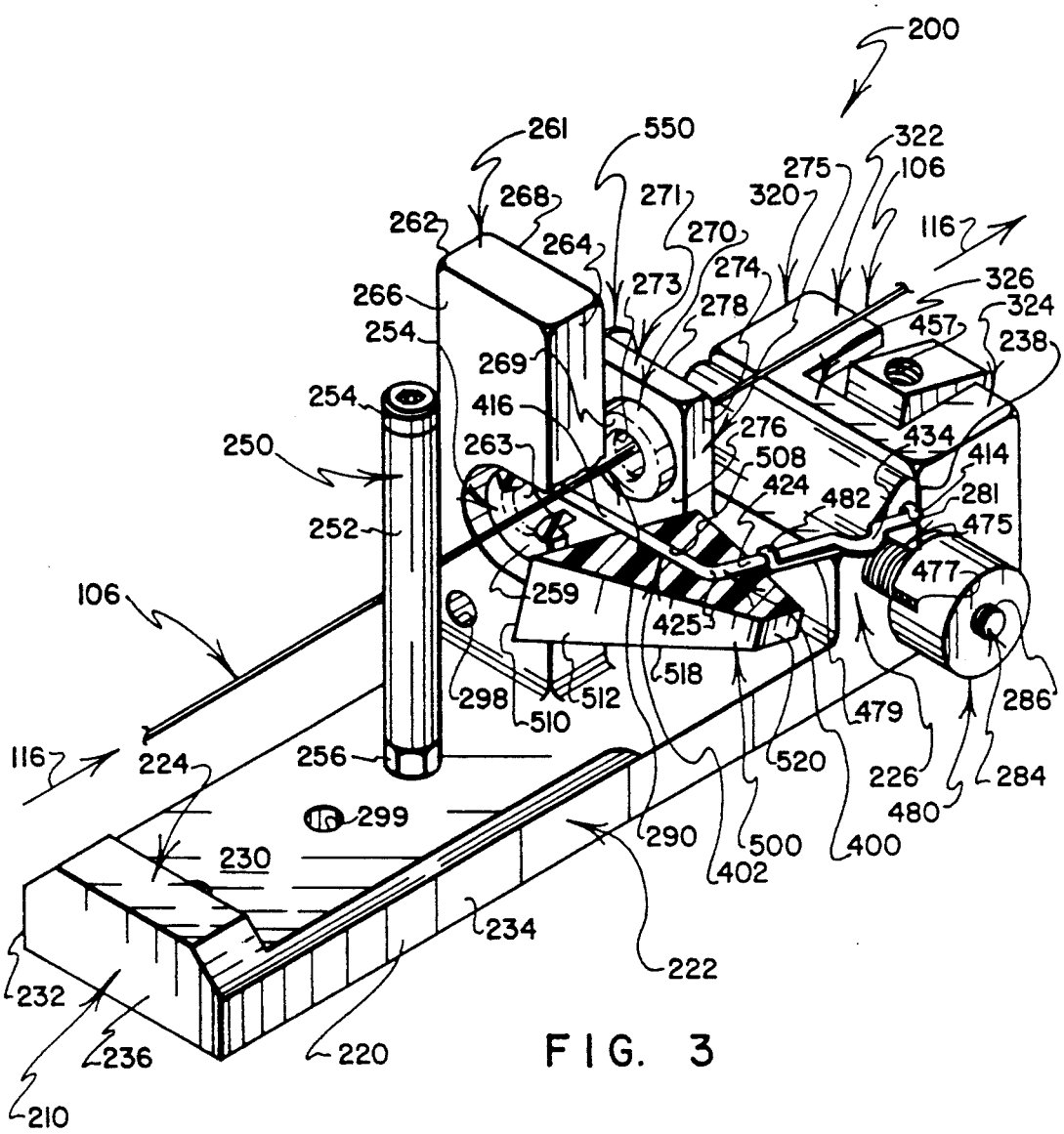
FIG. 3 is a right side perspective view of the indicator assembly of FIG. 2 with its components in the same relative positions as are shown in FIG. 2.

Referring to FIGS. 2–5 in conjunction with FIG. 1, it will be understood that the each of the feed paths 112, 114, 116, 118 extends alongside a post-like guide member 250 of its associated indicator assembly 200 (just like the strand 106 is depicted as extending alongside the post-like guide member 250 in FIGS. 2 and 3). Further, it will be understood that the each of the feed paths 112, 114, 116, 118 extends through aligned passages 263, 273 that are defined by eyelet-like guide members 260, 270 of its associated indicator assembly 200 (just like the strand 106 is depicted as extending through the aligned passages 263, 273 of the eyelet-like guide members 260, 270 in FIGS. 2 and 3).

Referring to FIGS. 2 and 3 wherein a representative strand 106 extending along a representative feed path 116 are depicted, it will be understood that, as each of the strands of material 102, 104, 106, 108 extends through its associated set of the aligned passages 263, 273, unbroken reaches 290 of strand material normally are defined between the associated set of spaced eyelet-like guide members 260, 270. A characteristic indication that a strand is unbroken and is being fed in a proper manner along its associated feed path is that its reach 290 is not only unbroken but also is held relatively taut. A characteristic indication that a strand is broken and/or is being fed improperly along its associated feed path is that its reach 290 is broken and/or not held relatively taut. Thus, it is for these distinguishing characteristics that the indicator assemblies 200 test to detect for strand breakage and/or for strand feeding problems, it being understood that the detected presence of any of these undesirable characteristics provides ample reason to halt the feeding of the strands 102, 104, 106, 108 along the feed paths 112, 114, 116, 118 so that any needed re-threading can be attended to, and so that other noted strand feeding problems can be rectified.

In FIG. 1, the three uppermost strands 104, 106, 108 are depicted as extending taut along their associated feed paths 114, 116, 118, while the lowermost of the strands 102 is depicted as having no taut reach 290 that extends along its associated feed path 112 between its associated set of eyelet-like guide members 260, 270. It is a condition such as is depicted in FIG. 1 in conjunction with the strand 102 (also depicted in FIG. 4 in conjunction with the strand 106) that the system of the present invention is particularly well suited to detect and to provide a signal that is indicative thereof, as will be explained in greater detail.

In overview, the indicator assemblies 200 rotate together with the rotary member 100 about the axis of rotation 110. During such rotation, the strands 102, 104, 106, 108 move, typically in unison, along the array of feed paths 112, 114,116, 118, respectively (i.e., just as the strand 106 is depicted as doing in FIGS. 2 and 3). Each of the strands 102, 104, 106, 108 typically passes alongside an associated one of the post-like guide members 250 which, in some instances, may assist a particular one of the strands 102, 104, 106, 108 in better aligning itself with the eyelet-like guide members 260, 270. From the vicinities of an associated one of the post-like guide members 250, each of the strands 102, 104, 106, 108 extends through aligned passages 263, 273 that are defined by an associated set of the guide members 260.270, whereafter, each of the strands 102, 104, 106, 108 continues to move along its associated feed path 112, 114, 116, 118, respectively.

Figure 4:
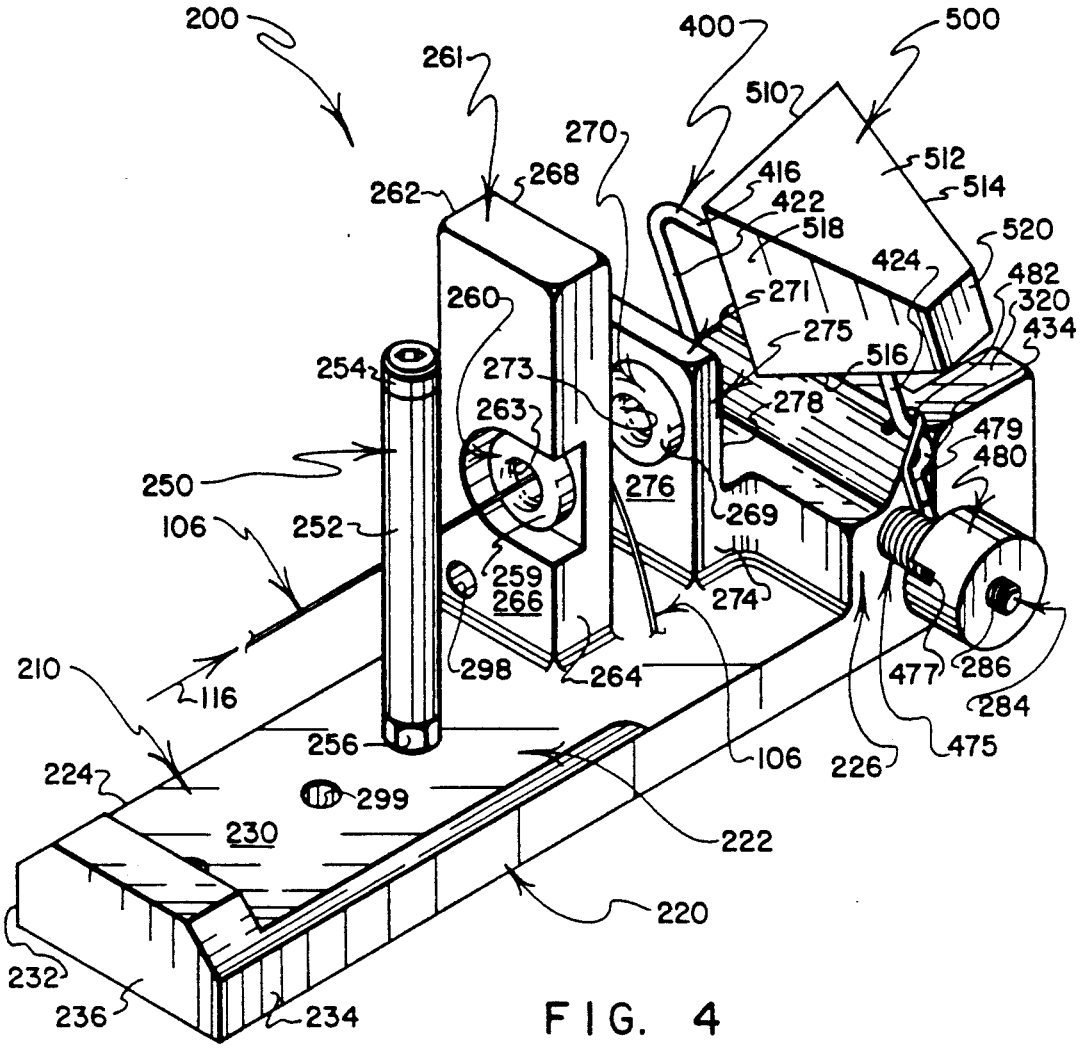
FIG. 4 is a right side perspective view similar to FIG. 3 but with the view showing the indicator arm and the indicator flag in "extended" positions that are assumed when the associated strand is broken or is otherwise caused to not be held taut as it extends along the associated feed path.

One function performed by the sets of spaced eyelet-like guide members 260, 270 is to serve as guides that assist such other guide structures (not shown) as may be desirable to provide in a particular application at locations upstream and/or downstream along the feed paths 112, 114, 116, 118 for confining the strands 102, 104, 106, 108 to desired paths of travel. However, a function of the spaced sets of guide members 260, 270 that is of greater importance to the practice of the present invention has to do with the service performed by each of the sets of guide members 260, 270 in providing and positioning a stable reach 290 of its associated strand that can be engaged by an associated indicator arm 400 that pivots to position an associated indicator flag 500 selectively in "nested" or "extended" positions. "Nested" positionings of a typical indicator flag 500 and its associated indicator arm 400 are depicted in FIGS. 2, 3, 5, 7 and 9. "Extended" positionings of the same indicator flag 500 and its associated indicator arm 400 are depicted in FIGS. 4 and 6 (and by phantom lines in FIG. 10).

Torsion coil springs 475 are provided as components of each of the indicator assemblies 200. Each of the springs 475 serves to bias its associated indicator arm 400 to pivot first toward its "nested" position wherein the arm 400 engages its associated strand reach 290. Normally, the taut nature of the associated strand reach 290 acts to overcome the biasing action of the associated torsion coil spring 450 such that pivotal movement of the associated arm 400 under the influence of the associated torsion coil spring 450 is halted with the arm 400 and its associated indicator flag 500 in a "nested" position such as is depicted in FIGS. 2 and 3. However, if the associated strand reach 290 is not taut and/or is missing, the pivotal movement of the arm 400 under the influence of the associated torsion coil spring 450 will continue so as to move the arm 400 away from its "nested" position and into its "extended position" thereby "raising" or "extending" the associated flag 500, as is depicted in FIG. 4.

Referring once again to FIG. 1, an optical detector that cooperates with the indicator assemblies 200 is indicated generally by the numeral 600. The detector includes a source 602 of electromagnetic energy such as light that serves to project a beam of such energy along a beam path 604 from the source 602 to a fast-acting sensor 606. In preferred practice, the sensor 606 comprises any of a variety of suitably fast-acting solid-state devices that are available commercially and that will provide a suitable signal in response to only a momentary interruption in the transmission of energy along the beam path 604 from the source 602 to the sensor 606.

The beam path 604, as depicted in FIG. 1, is arranged to extend beneath the rotary member 100 and to precisely intercept an imaginary circle (indicated by the numeral 610) that is followed by each of the indicator flags 500 when the indicator flags 500 are in their "extended" or "raised" positions. The beam path 604 is carefully oriented to assure that the only portions of the indicator assemblies 200 that can interrupt the transmission of light along the beam path 604 are "extended" ones of the indicator flags 500. Inasmuch as each of the indicator flags 500 passes by the beam path 604 during each revolution of the indicator assemblies 200 about the axis 110, once one of the flags 500 has moved to its "extended" position, it will require less than a revolution of movement of indicator assemblies 200 about the axis 110 for the "extended" indicator flag 500 to interrupt the transmission of energy along the beam path 604, whereby a signal that is indicative of strand breakage is provided by the fast-acting sensor 606.

In preferred practice, the sensor 606 provides a "strand breakage" electrical signal that is utilized in a conventional way to initiate the sounding of an audible alarm (not shown) and/or to stop not only the feeding of the strands of material 102, 104, 106, 108 along their associated feed paths 112, 114, 116, 118 but also rotation of the rotary member 100 that mounts the indicator assemblies 200. During such a shut-down, it is possible to safely check the threading of the various strands of material 102, 104, 106, 108, to repair broken strands, and to correct any noted feeding problems.

Other features that will be explained in greater detail include the formation of the indicator arm 400 from a piece of wire; the manner in which the indicator arm 400 is pivotally connected to the base assembly 210 by inserting portions of the arm 400 into a notch formed in a main body portion 220 of the base assembly 210 that is closed by an end cap 320 of the base assembly 210; the provision of a counterweight 450 attached to the arm 400 to assist in rendering the arm 400 insensitive to centrifugal force and to changes in speed of rotation of the indicator assemblies 200 about the axis 110; the manner in which the indicator flag 500 preferably is formed and is rigidly mounted on the indicator arm 400; and the nature of a latch 550 that is provided to enable the indicator arm 400 and the indicator flag 500 to be "locked down" during re-threading of strands along the various feed paths.

Turning now to a more detailed discussion of the features of the various component parts that form each of the indicator assemblies 200, and referring to the typical indicator assembly 200 that is depicted in FIGS. 2 and 3 during normal feeding of the uppermost strand 104, each of the indicator assemblies 200 includes a base assembly that is indicated generally by the numeral 210. Each of the base assemblies 210 includes a main body member 220 and an end cap member 320 that are rigidly connected together.

The main body member 220 has a relatively flat base portion 222. The base portion 222 includes an enlarged front end region 224, an upstanding rear end region 226 and a relatively flat, elongate central region 228 that extends between and integrally connects the front and rear end regions 224, 226. A relatively flat, elongate top surface 230 is defined by the central region 228. Opposed upstanding side surfaces 232, 234 extend along opposite sides of the end and central regions 224, 226, 228. Opposed upstanding front and rear end surfaces 236, 238 are defined by the front and rear end regions 224, 226, respectively. The surfaces 232, 234, 236, 238 cooperate to give the base portion 222 a generally rectangular shape. The regions 224,226, 228 have a substantially uniform width (measured as the distance between the opposed side surfaces 232, 234) that is about a third of the length of the top surface 230.

Formed integrally with the base portion 222 and extending upwardly from the top surface 232 of the central region 228 thereof are a relatively tall formation 261, and a relatively short formation 271. The relatively tall formation 261 has opposed upstanding side surfaces 262, 264, and opposed upstanding front and rear surfaces 266, 268 that give the relatively tall formation 261 a substantially rectangular cross section. The relatively short formation 271 has an upper portion 275 that is of substantially rectangular cross section, and which is bounded by opposed upstanding side surfaces 272, 274, and by opposed upstanding front and rear surfaces 276, 278.

The relatively tall formation 261 extends upwardly from the top surface 232 to a height that is about twice the maximum height of the relatively short formation 271. The relatively tall formation 261 and the upper portion 275 of the relatively short formation 271 have widths (as measured between their opposed side surfaces 262, 264 and 272, 274) that are about half the width of the base 222. The upwardly extending side surfaces 262, 272 are formed as contiguous extensions of the side surface 232 of the base 222.

Figure 10:
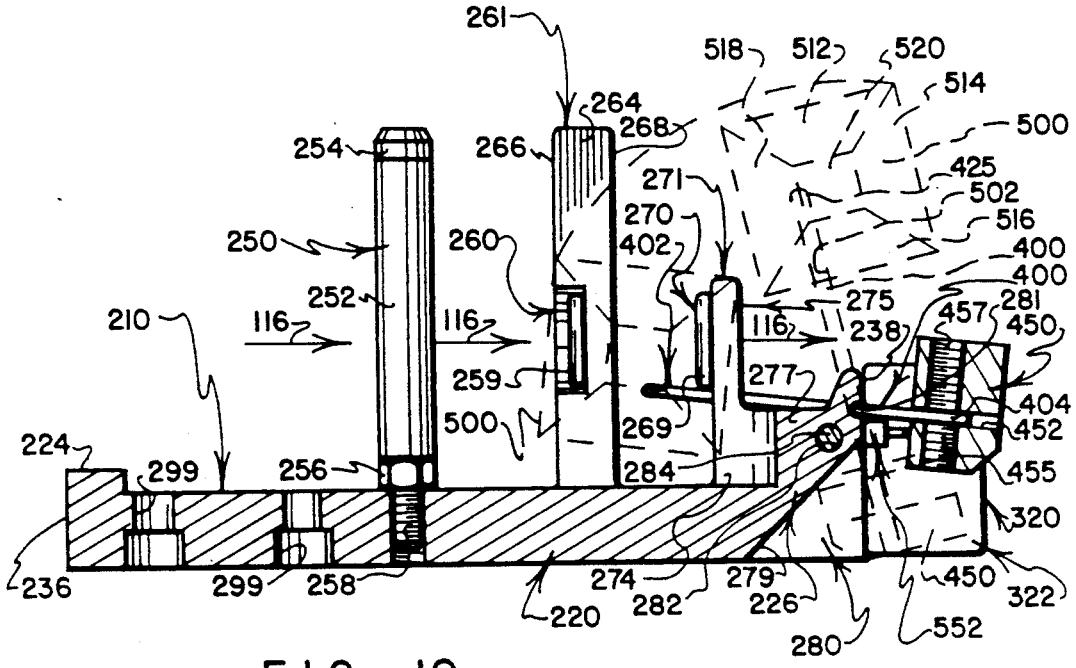

The relatively short formation 271 has a complexly configured lower portion 277 that underlies the upper portion 275 and that widens as it extends rearwardly so as to join smoothly with and to define portions of the the enlarged rear end region 226 of the body member 220. As is best seen in FIG. 10, a centrally located, downwardly and rearwardly opening space 280 is defined by the rear end region 226 to provide space for pivotal movement of the counterweight 450 as the arm 400 pivots to its "extended" position. An inclined stop surface 279 defines the front end of the space 280 and is configured to be engaged by the counterweight 450 to limit pivotal movement of the indicator arm 400 under the influence of the biasing spring 475 beyond what is known as its "extended" position.

Figure 9:
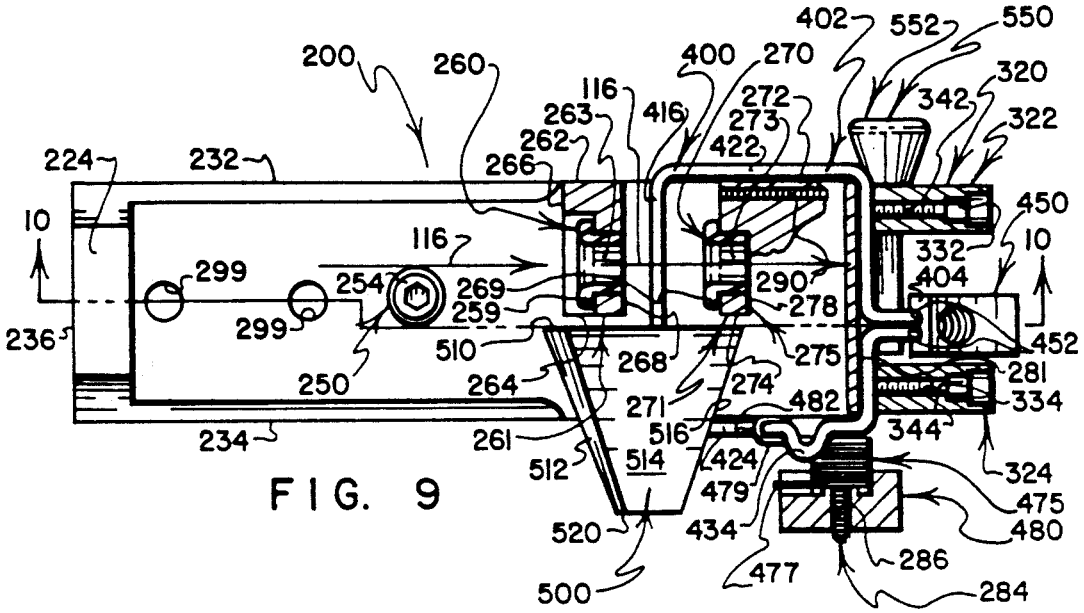
FIG. 9 is a top plan view of the indicator assembly with its components positioned as in FIG. 5, with portions of the body of the indicator assembly being broken away to permit otherwise hidden features to be seen; and, FIG. 10 is a sectional view thereof as seen from a broken line 10—10 in FIG. 9.

Referring to FIGS. 9 and 10, a few additional details regarding the three guide members 250, 260, 270 should be mentioned. The guide member 250 includes an elongate ceramic sleeve 252 that is capped at its top by the head of a cap screw 254, and that rests atop a hex nut 256 that is threaded onto a threaded lower end region 258 of the cap screw 254. The threaded lower end region 258 is threaded into a hole 259 that is formed through the main body member 220 of the base assembly 210, as is best seen in FIG. 10.

The eyelet-like guide members 260, 270 are ceramic eyelets that are held in holes formed through the upstanding formations 261, 271, respectively, by means of epoxy adhesive. The openings 263, 273 that extend through the eyelets 260, 270 open at their front ends through circumferentially extending rim formations 259, 269.

Referring to FIG. 10, a slot, indicated generally by the numeral 281, opens through the rear end surface 238 of the main body member 220 at a location above where the inclined surface 279 joins the rear end surface 238. The slot 281 extends the full width of the rear end surface 238 and, as will be explained, is utilized to effect a pivotal mounting of the indicator arm 400.

Figure 6:
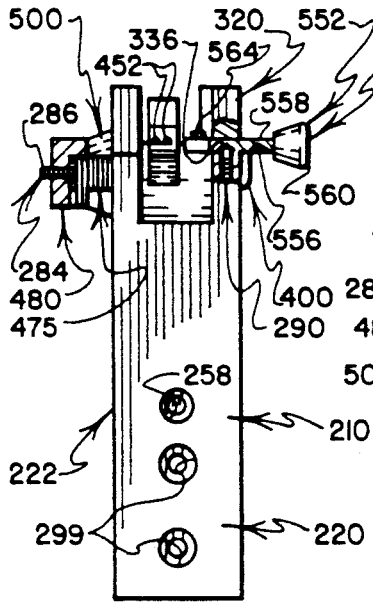
FIG. 6 is a bottom plan view of the indicator assembly with its components positioned as in FIG. 4, with portions of the body of the indicator assembly being broken away to permit latch pin detent features that are otherwise hidden to be seen.
Figure 7:
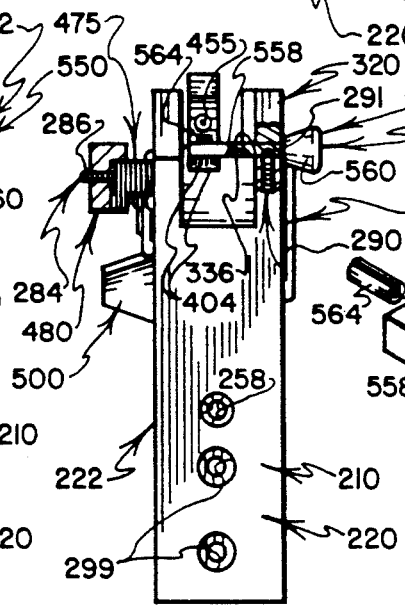
FIG. 7 is a bottom plan view similar to FIG. 6 but with the components of the indicator assembly positioned as in FIG. 5.

Referring to FIG. 10, a threaded hole 282 is formed in the enlarged rear end region 226 of the main body member 220 at a location slightly below and slightly forward of the location of the slot 280. A threaded mounting stud 284 is threaded into the hole 282. Referring to FIGS. 6, 7 and 9, the threaded stud 284 has a threaded outer end region 286 onto which a knob 480 is threaded. The knob 480 is configured to receive and drivingly connect with one end region 477 of the torsion coil spring 475 that biases the indicator arm 400 toward its "extended" position. The other end region 479 of the torsion coil spring 475 is provided with a hook-shaped formation 482 that connects with a portion of the wire-form indicator arm 400, which will be described shortly. The internal threading of the knob 480 and the externally threaded outer end region 286 cooperate to provide the knob 480 with a relatively tight fit which, nonetheless permits the position of the knob 480 on the threaded outer end region 286 to be adjusted to serve as a means for selectively adjusting the torsion force that is applied by the torsion coil spring 475 to the indicator arm 400.

Figure 8:
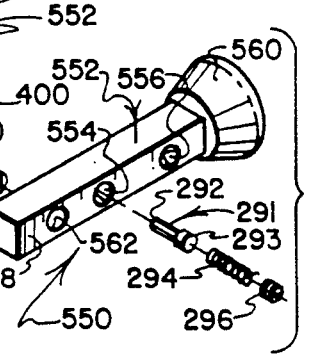
FIG. 8 is an exploded perspective view, on an enlarged scale, of the latch pin components and such detent components as interact with the latch pin.

Referring to FIGS. 6, 7 and 9, a hole 290 is formed through the enlarged rear end region 226 to mount detent components that are depicted in FIG. 8, namely a detent pin 291 that has a rounded formation 292 at one end and a head formation 293 at the other end, a compression coil spring 294, and a short, small diameter set screw 296 that is threaded into the forward end region of the hole 290. The rounded formation 292 of the detent pin 291 projects through the rear end of the hole 290 (i.e., where the hole 290 opens through the rear wall 226 of the main body portion 220) for engaging the latch pin 552 that is depicted in FIG. 8. The spring 294 is interposed between the set screw 296 and the head formation 293 for biasing the rounded end 292 of the detent pin 291 rearwardly to engage the latch pin stem 558. The spring-biased detent pin 291 prevents the latch pin 552 from moving unless force is applied to it. When the rounded end 292 of the detent pin 291 is received within one or the other of two dimple-like recesses 554, 556 that are formed in one side of a square stem portion 558 of the latch pin 552, the pin 291 serves to selectively detain the latch pin 552 in one or the other of its latched or unlatched positions.

Figure 5:
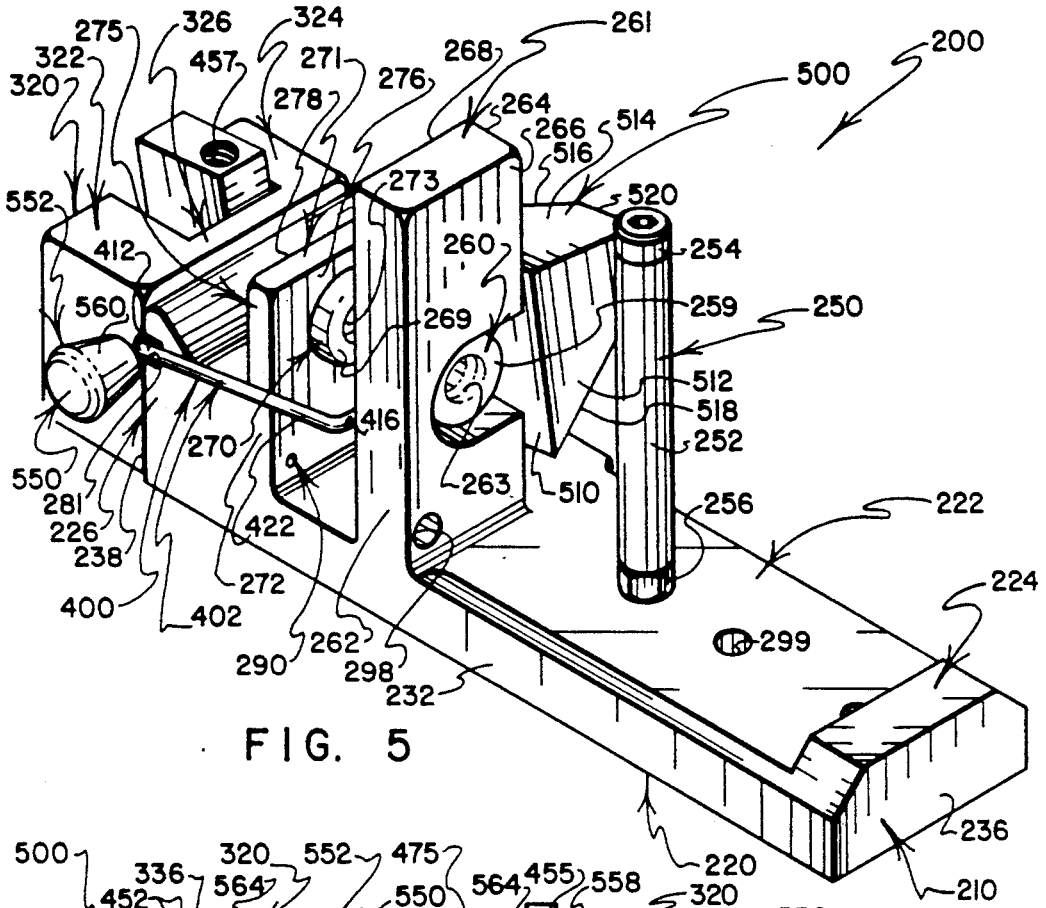
FIG. 5 is a left side perspective view similar to FIG. 2 but with the view showing the indicator arm and the indicator flag in "latched down" positions that are assumed when a latch pin is pushed inwardly to hold down the indicator arm and the indicator flag, as typically is done during threading of an associated strand along the associated feed path.

Referring to FIGS. 2, 5 and 9, it will be seen that the front end of the threaded hole 290 opens through the front face of the upstanding formation 271. So that an Allen wrench can be used conveniently to thread the set screw 296 into the front end region of the hole 290, a larger diameter access hole 298 is formed through the upstanding formation 261 in alignment with the hole 290.

Referring to FIGS. 9 and 10, a pair of mounting holes 299 are formed through the base portion 222 of the main body member 220 to receive suitable threaded fasteners (not shown) for rigidly connecting the indicator assemblies 200 to the rotary member 100.

Turning now to a brief discussion of features of the end cap member 320 that cooperates with the main body member 220 to form the base assembly 210, and referring principally to FIGS. 1–3 and 5, the end cap member 320 features a pair of substantially rectangular, left and right block-like side portions 322, 324 that are interconnected along a portion of the rear wall of the main body member 220 by a bridging portion 326. Referring to FIG. 9, threaded fasteners 332, 334 extend through holes 342, 344 that are formed in the block-like side portions 322, 324, respectively, and are threaded into aligned holes (not shown) that are open through the rear surface 226 of the main body member 220. The fasteners 332, 334 are tightened securely in place to rigidly connect the end cap member 320 to the main body member 220.

Referring to FIG. 2, the block-like side portions 322, 324 are substantially identical in appearance except that a square passage 336 is formed in the left block-like side portion 322 to permit the stem 558 of the latch pin 552 (shown in FIG. 8) to be received in the passage 336 in a slip fit when the end cap member 320 is rigidly connected to the main body member 220. Referring to FIG. 8, the latch pin 552 has a graspable tapered head formation 560 at its outer end, a hole 562 drilled through its stem near its inner end, and provides the two dimple-like detent recesses 554,556 at locations that are spaced along the stem 558 between the head formation 560 and the hole 562. A roll pin 564 is pressed into the hole 562 but is too long to be fully inserted into the hole 562, thereby leaving a projecting end of the roll pin 564 to serve as a stop that prevents the stem 558 of the latch pin 552 from being entirely withdrawn from the passage 336.

In FIGS. 2 and 6, the latch pin 552 is shown projecting relatively far outwardly with respect to the passage 336, with this representing the "unlatched" position of the latch pin 552. In its unlatched position, the latch pin 552 is entirely withdrawn from such paths of movement as are followed by portions of the indicator arm 400 when the indicator arm 400 pivots to move the indicator flag 500 between "nested" and "extended" positions. In FIGS. 5, 7 and 9, however, the latch pin 552 is shown inserted relatively far into the passage 336, with this representing the "latched" position of the latch pin 552. In its latched position, the latch pin 552 underlies portions of the wire-form structure that forms the indicator arm 400 so as to engage the arm 400 at a location that is between the spaced, block-like side portions 322, 324, but at a location that is forward with respect to the location of the counterweight 450 (as is best seen in FIG. 7). When the latch pin 552 is "latched," the indicator arm 400 and the indicator flag 500 are "latched down" such that all portions of the indicator arm 400 are held beneath the path that needs to be followed by a strand of material that is being inserted through the eyelet-like guide members 260, 270 as during "threading" of a strand 106 along the feed path 116.

While a principal use of the latch pin 552 is to "latch down" the indicator arm 400 and the indicator flag 500 so that these members do not interfere with threading of a strand 106 along the feed path 116, another use to which the latch pin 552 can be put is to securely retain the indicator arm 400 and the indicator flag 500 in "retracted" or "nested" positions when one or more of an array of indicator assemblies 200 is not being used, but while others of the indicator assemblies 200 are being used to assist with feeding of a limited number of strands along selected ones of the available feed paths. If the unused indicator assemblies 200 are not "latched down," their indicator flags 500 will provide false "strand broken" signals to the stationary detector 600.

Referring principally to FIGS. 3 and 9, the indicator arm 400 is formed by shaping a length of wire to provide generally rectangular loop 402, but with opposite end regions 404 of the length of wire (see FIG. 9) being turned away from the loop 402 and positioned to extend in abutting side-by side relationship to be received in side-by-side holes 452 (see FIGS. 9 and 10) that are drilled through the counterweight 450. A secure connection is established between the counterweight and the side-by-side end regions 404 by utilizing a set screw 455 (see FIG. 10) that is securely tightened into a threaded passage 457 which intersects with the side-by-side holes 452.

Referring once again to FIGS. 3 and 9, the generally rectangular loop 402 has a pair of aligned, transversely extending reaches 412, 414 that connect with the end regions 404 and that are received in the previously described slot 281 that extends transversely across the back wall 226 of the main body member 220. When the end cap member 320 is rigidly connected to the main body member 220 as has been described, portions of the end cap member 320 serve to prevent the reaches 412, 414 from escaping from the slot 281, by which arrangement the indicator arm 400 is securely pivotally mounted on the base assembly 210.

Completing the generally rectangular loop 402 is a reach 416 that extends in spaced parallel relationship with the aligned reaches 412, 414, and a pair of left and right reaches 422, 424. The left reach 422 extends from the left end region of the reach 416 to the left end region of the reach 412. The right reach 424 extends from the right end region of the reach 416 to the right end region of the reach 414.

The reach 416 is referred to as the "strand-engaging portion" of the indicator arm 400, for it is the reach 416 that is biased by the torsion coil spring 475 into engagement with the reach 290 of the strand 106 when the strand 106 is unbroken and is feeding normally and with proper tautness along its associated feed path 116.

Each of the reaches 416, 422, 424 consist of straight lengths of wire with "corner" junctions of the loop 402 being characterized by smooth curves; however, along the reach 424 at a position relatively near its junction with the reach 414, a small U-shaped bend provides an formation 434 that is engaged by the end region 479 of the torsion spring 475. The engagement of the end region 479 with the formation 420 facilitates the transfer of biasing force from the torsion coil spring 475 to the wire-form indicator arm 400.

Referring to FIGS. 3 and 9, the indicator flag 500 is rigidly connected to the wire-form loop 402 of the indicator arm 400 within the vicinity of a corner region 425 that forms the juncture between the reaches 416, 424. The indicator flag 500 preferably is formed either as a single relatively lightweight molded plastic member that has a passage 502 formed therethrough for purposes of receiving the corner region 425, or is formed as a pair of left and right members that are molded from lightweight plastic material and that cooperate, when assembled and secured in place with suitable adhesive, to accommodate the corner region 425. If the indicator flag 500 is formed as in one piece, a slit (not shown) must be cut to permit the corner region 425 to be inserted to its proper position, as is shown in FIG. 3, whereafter the slit portions are reconnected by means of suitable adhesive.

Regardless of whether the indicator flag 500 is formed in one piece or by adhesively connecting a plurality of component parts, the preferred final shape of the indicator flag 500 is defined by a relatively large, substantially square side wall 510, an opposed, relatively small, substantially square side wall 520, and by four trapezoidal shaped walls 512, 514, 516, 518 that cooperate to join aligned edges of the opposed side walls 510, 520.

While indicator flag described and illustrated as being formed from relatively lightweight resilient material that is shaped into a trapezoidal-sided sort of "cube," those skilled in the art readily will understand that "flags" formed from other materials and having any of a wide variety of alternate configurations can be used without departing from the spirit of the present invention.

As is best seen in FIG. 10, except for the presence of the described holes 452 and passage 457, the counterweight simply consists of a generally rectangular block of steel that has one corner portion thereof slightly relieved in order to permit the counterweight 450 to pivot freely with the indicator arm 400 about the axis of the slot 281 wherein aligned reaches 412, 414 of the loop 402 are journaled for pivotal movement. On the other hand, the mass of the counterweight 450 needs to be correct in order for the counterweight 450 to properly perform its intended function, namely to render the assembly consisting of the pivotally mounted indicator arm 400, the indicator flag 500, the counterweight 450 and the set screw 455 substantially immune to the influence of centrifugal force and to changes in rotational speed while the indicator arm 400 is in normal engagement with an associated strand 106 that is being fed in a normal, desirable manner along its associated feed path 116.

In preferred practice, the mass of the counter-weight 450 together with the mass of the indicator arm reaches 404 that extend from the axis of the slot 281 to mount the counterweight and the mass of the set screw 455 that connects the counterweight 450 to the reaches 404 should be substantially equal to the mass of such portions of the indicator arm 400 as extend in the opposite direction from the axis of the slot 281 together with the mass of the indicator flag 500. With this balance, the needed biasing force for pivoting the indicator arm 400 and the indicator flag 500 are provided by adjusting the knob 480 to utilize the torsion coil spring 475 to suitably apply biasing force to the indicator arm 400.

During normal feeding of strands of material along separate feed paths that extend through the eyelets 260, 270 of separate ones of the indicator assemblies 200, the strand-engaging portions of the unlatched indicator arms 400 are biased into engagement with their associated strand reaches 290, and the taut nature of the strand reaches 290 that are engaged by the arms 400 counteracts the tendency of the associated torsion coil springs 475 to pivot the indicator arms 400 to their extended positions. However, if one of the strands that is being fed along its associated feed path should break or otherwise come to lose its normal degree of tautness, the engagement of the associated indicator arm 400 with the associated strand reach 290 either will no longer continue to take place or will be insufficient to oppose the tendency of the associated torsion coil spring 475 to pivot the associated indicator arm 400 to its extended position, whereby movement of the indicator arm 400 to its extended position will signal that feeding of strands should cease until any broken strands and/or other types of feeding problems have been rectified.

If even one of the flag-carrying indicator arms 400 is moved to its extended position, its associated flag 500 will be positioned to extend between the light source 602 and the light detector 606 so as to cause a brief break in continuity of the beam of light 604 that is being transmitted by the source 602 to the detector 606, and a suitable signal will be provided. Such a signal may be used to sound an alarm and/or to effect an automatic shutdown of the feeding of strands along their feed paths so that the detected problem can be fixed quite promptly, thereby permitting the system to be put back into service as quickly as possible.

Because the array of indicator assemblies rotates about the imaginary axis of rotation 110, and because the optical detector 606 does not require that the detected light beam that is being emitted by the source 602 be broken more than once in order for a breakage indicator signal to be generated substantially instantly once a break in the transmission of the beam of light has taken place, the maximum amount of time that is required by the system of the present invention to generate a signal that is indicative of strand breakage is substantially equal to the amount of time that is required for the rotating array of indicator assemblies 200 to execute one revolution about the axis of rotation 110. To require such a maximum amount of time would mean that immediately after a strand breakage indicator passes by the optical sensor 600 with its flag 500 retracted, the associated flag-carrying arm 400 is caused to move to its extended position so that, when the flag 500 is next within the vicinity of the optical sensor 600, it breaks the beam of light 604 thereby causing the substantially instantaneous generation of a strand breakage signal.

If the speed of rotation of the array of indicator assemblies 200 is a mere 60 revolutions per minute (i.e., one revolution per second), it should not require more than a second after breakage takes place for the optical sensor to have its light beam broken by passage of a flag-extended indicator assembly. Since breakage signal generation time diminishes in accordance with increases in the speed of rotation, if the array of strands being fed is rotating at a much higher speed of rotation such as 1200 revolutions per minute (i.e., 20 revolutions per second), it would should not require more than about one twentieth of a second for a breakage signal to be generated.

In operation, it is desirable to set the knobs 480 that control the torsion force that is exerted on the flag-carrying arms 400 by the springs 475 about as high as will not in some way cause interference with the feeding of strands of material along their feed paths. This is because the force with which the flag-Carrying arms are biased toward their extended positions can affect the speed with which the arms move from their normally nested position to extended positions—and, in order to provide the fastest possible signal of breakage, it is advantageous to cause the flag-carrying arms to execute their movements from nested to extended positions in the least possible time.

A feature of the flag-carrying arm design that is employed in the preferred practice of the present invention is that each of the flag-carrying arms 400 is counterbalanced such that, when each arm is in its normal nested position (i.e., in a position wherein its strand-engaging portion is in engagement with a taut reach of strand material that extends between the associated eyelets 260,270), the effect that centrifugal force cause by rotation will have on the arm is "neutralized"—thus, the arms cannot be caused to move or to exert undue force on the strand as the result of the action of centrifugal force on the counterbalanced flag-carrying arms 400.

A further feature of the preferred practice of the present invention resides in the degree of versatility that is provided by using indicator assemblies of the type that are described above. If less than a full capacity of strands are to be fed, the latch pins 452 can be used to restrain flag-carrying arms of unused ones of the indicator assemblies 200 thus permitting the feeding of any number of strands up to and including the maximum number of feed paths that are defined by the system. If strands of material are to be fed that differ in characteristics from strands that previously were fed, the knobs 480 easily can be adjusted to assure that the force with which the flag-carrying arms engage the new set of strands will be appropriate.

While the arrangement illustrated in the drawings and described herein is one wherein all of the indicator assemblies 200 are arranged in a common circle that is concentric about the rotation axis, and while only one optical detector has been shown, those who are skilled in the art readily will understand and appreciate that more than one optical detector (or other types of detectors) may be used with each circle of indicator assemblies, and that a plurality of circles of indicator assemblies may be employed so that the feeding of substantially any number of strands along intermingled arrays of feed paths served by substantially any desired number of detectors can be utilized without departing from the spirit and scope of the claimed invention.

While the indicator assemblies 200 have been shown oriented in accordance with the preferred practice of the present invention (with strands that are being fed moving past the upstanding post-like guides 250 before passing through the eyelets 260, 270), it has been found that the indicator assemblies 200 also will function quite well if they are "reversed" so that the strands pass through the eyelets 270, 260 before passing beside the post-like guides 250.

Although the aforedescribed structure and certain of its components parts are depicted in the drawings as extending substantially vertically, substantially horizontally or in some other orientation, it should be kept in mind that a feature of the system of the present invention resides in the fact that it can be used with arrays of strand feed paths that extend in substantially any conceivable orientation. Thus, while such terms as "horizontally extending," "vertically extending," "left," "right", and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A system for sensing breakage of one or more of a plurality of strands of material that are being fed substantially in unison along an array of separate feed paths while the array of feed paths is being rotated about an axis of rotation that extends substantially centrally among the feed paths, comprising:

a) indicator means for detecting breakage of one or more of the strands including a plurality of indicator assemblies that each have guide means positioned along a separate one of the feed paths for guiding an associated strand of material for movement along its associated feed path, with the indicator assemblies extending in a substantially circular array that is substantially concentric about the axis of rotation whereby, when the array of indicator assemblies is rotated together with the array of feed paths about the axis of rotation, each of the indicator assemblies is caused to move along a common circular path that is substantially concentric about the axis of rotation;

b) detector means positioned alongside the common circular path so that, when the array of indicator assemblies is rotated about the axis of rotation, each of the indicator assemblies is caused to move past the detector means at least once during each revolution of such rotation; and, c) with each of the indicator assemblies having flag means including an indicator flag connected to the associated guide means for moving relative thereto from a nested position to an extended position in response to sensed breakage of the associated strand, with the positioning of any of the indicator flags in its extended position being detected by the detector means, and with the detector means providing a signal that is indicative of sensed strand breakage in response to detection of any of the indicator flags in its extended position.

2. The system of claim 1 wherein the detector means includes optical detector means for providing said signal in response to optical detection of the positioning of any of the indicator flags in its extended position during rotation of the indicator assemblies along the common circular path past the detector means.

3. The system of claim 1 wherein the detector means includes source means for directing electromagnetic energy along a beam path, and receiver means for receiving electromagnetic energy that is directed along the beam path by the source means and for providing said signal in response to even a momentary cessation of receipt of such electromagnetic energy as is directed along the beam path by the source means, with the source means and the receiver means being positioned at spaced locations along the beam path, and with the beam path being oriented to be interrupted by passage between the source means and the receiver means during rotation of the indicator assemblies along the common circular path of any of the indicator flags that is in an extended position.

4. The system of claim 3 wherein the electromagnetic energy that is directed along the beam path by the source means is light, the receiver means is operative to rapidly provide said signal in response to an interruption of receipt of a beam of light that is directed along the beam path by the source means, and each of the indicator flags is operative when in its extended position and while being moved between the source means and the receiver means to interrupt receipt by the receiver means of light directed along the beam path by the source means.

5. The system as in claims 1, 2, 3 or 4 wherein each of the indicator assemblies includes arm means for being rigidly connected to its associated indicator flag and for being pivotally connected to its associated body for pivotal movement about an associated pivot axis to effect movement of the associated indicator flag between its nested and extended positions.

6. The system of claim 5 wherein each of the arm means includes a wire-form member having a) a pivot portion that extends along the associated pivot axis, and b) a mounting portion that is spaced to one side of the associated pivot axis, and each of the indicator flags is rigidly connected to its associated mounting portion to form an arm assembly means for pivotal movement about the associated pivot axis to effect movement of the indicator flag of the arm assembly means between its associated nested and extended positions.

7. The system of claim 6 wherein each of the arm assembly means of each of the indicator assemblies additionally includes counterbalance means for being connected to its associated wire-form member for counter-balancing the arm assembly means such that, when the arm assembly means is oriented to position its associated indicator flag in its associated nested position, any effect that forces which are caused by rotation of the indicator assemblies about the axis of rotation may have that tends to move its associated indicator flag out of its associated nested position will be minimized.

8. The system of claim 7 wherein each of the wire-form members has a portion that extends to one side of its associated pivot axis to interconnect its associated mounting portion with its associated pivot portion, and another portion that extends to substantially an opposite side of its associated pivot axis to connect with and mount the counterbalance means thereon; and, the mass of the counterbalance means is selected such that, when the counterbalance means is connected to the associated wire-form member to form a part of the associated arm assembly means, the mass of such portions of the arm assembly means as extend to said one side of its associated pivot axis is counterbalanced by the mass of such portions of the arm assembly means as extend to said opposite side of its associated pivot axis.

9. The system as in claims 1, 2, 3, or 4 wherein each of the indicator assemblies additionally includes separate biasing means connected to its associated guide means for biasing its associated flag means toward its associated extended position.

10. The system of claim 9 wherein each of the separate biasing means includes a separate torsion coil spring that has one end region connected to its associated guide means, and another end region connected to its associated flag means.

11. The system of claim 10 wherein each of the separate biasing means includes adjustment means for being adjusted to control the biasing force that is interposed between the associated guide means and the associated flag means.

12. The system as in claims 1, 2, 3 or 4 wherein each of the indicator assemblies additionally includes separate latch means connected to the guide means and being selectively movable between latched and unlatched positions wherein the latch means functions to selectively prevent and permit movement of its associated flag means out of its associated nested position toward its associated extended position.

13. The system of claim 12 wherein the separate latch means that is connected to each of the guide means includes an elongate latch pin member that is slidably mounted by the guide means for movement between its associated latched and unlatched positions, and detent means is interposed between the latch pin member and its associated guide means to assist in releasably retaining the latch pin member in a selected one of its associated latched and unlatched positions.

14. The system of claims 1, 2, 3 or 4 wherein each of the guide means includes a pair of guide formations that define through passages that surround the associated feed path for a strand of material at spaced locations therealong, and the associated flag means has strand-engagement formation means connected thereto for engaging a taut reach of strand material that extends along the associated feed path at a location that is between the spaced locations of the associated guide formations, with the engagement of said strand-engagement formation means with the taut reach of strand material serving to prevent movement of the flag means from its associated nested position to its associated extended position, and with the absence of a taut reach of strand material extending along the associated feed path at said location between the spaced location of the associated guide formations serving to permit movement of the flag means from its associated nested position to its associated extended position.

15. A system for sensing breakage of one or more of a plurality of strands of material that are being fed substantially in unison along an array of separate feed paths while the array of feed paths is being rotated about an axis of rotation, comprising:

a) stationary means including base structure for supporting rotatable means and for mounting stationary detector means thereon;

b) rotatable means connected to the stationary means for rotation relative thereto about an axis of rotation, including rotatable structure for defining an array of separate feed paths along which strands of material are movable substantially in unison while the rotatable structure rotates relative to the stationary means about the axis of rotation;

c) with the rotatable means additionally including:

i) guide means connected to the rotatable structure including a plurality of separate sets of guides, with each of the separate sets of guides being positioned along a separate one of the feed paths that are defined by the rotatable structure;

ii) with each of the sets of guides including at least two spaced guide formations that each define a through passage that surrounds its associated feed path to assist in guiding along its associated feed path a reach of strand material that bridges such space as extends between the two spaced guide formations;

iii) indicator means including a plurality of separate indicator arms that each are associated with a separate one of the sets of guides, with each indicator arm being pivotally connected to the rotatable structure for movement relative thereto about an associated pivot axis, with each indicator arm having a strand engagement formation that is extensible into the space that extends between its associated pair of guides to engage the associated reach of strand material that bridges such space, and to thereby detect for breakage of the associated strand as the strands are moved along the separate feed paths, and as the array of feed paths is rotated about the axis of rotation;

iv) flag means including a separate indicator flag connected to each of the indicator arms for pivotal movement about the associated pivot axis, with the range of permitted movement of each of the indicator arms extending at least between an associated nested position of the arm wherein the flag means is held relatively close to other portions of the associated indicator means, and an extended position of the arm wherein the flag means is extended so as to project away from other portions of the associated indicator means;

v) biasing means connected to the rotatable structure for separately biasing each of the indicator arms in a direction that extends both toward its associated nested position and toward its associated extended position, with effect of the operation of the biasing means on each of the indicator arms being such that:

i) if an associated strand reach is engaged by its associated strand engaging formation while the strand reach is being held taut (as is characteristic when the associated strand is unbroken and is being properly fed along its associated feed path), the biasing means simply biases the associated strand engaging formation into engagement with the associated strand reach and positions the associated indicator flag in its associated nested position; however, ii) if an associated strand reach is absent or is not found to be held taut when engaged by its associated strand engagement formation (as is characteristic when the associated strand is broken or otherwise is failing to be fed properly along its associated feed path), the biasing means causes the associated strand engaging formation to move beyond where it would normally be held by its engagement with a taut strand reach, and positions the associated indicator flag in its associated extended position; and, d) detector means connected to the base structure for being mounted in a stationary position alongside a path of movement that is followed by such ones of the flag means as are positioned in their extended positions for providing a signal that is indicative of sensed breakage of one or more of the strands that are being fed along the rotating array of feed paths in response to detection by the detector means of the passage of one or more of the extended indicator flag means.

16. The system of claim 15 wherein the detector means includes optical detector means for providing said signal in response to optical detection of the positioning of any of the indicator flags in its extended position.

17. The system of claim 15 wherein the detector means includes source means for directing electromagnetic energy along a beam path, and receiver means for receiving electromagnetic energy that is directed along the beam path by the source means and for providing said signal in response to even a momentary cessation of receipt of such electromagnetic energy as is directed along the beam path by the source means, with the source means and the receiver means being positioned at spaced locations along the beam path, and with the beam path being oriented to be interrupted by passage between the source means and the receiver means during rotation of the indicator assemblies of any of the indicator flags that is in an extended position.

18. The system of claim 17 wherein the electromagnetic energy that is directed along the beam path by the source means is light, the receiver means is operative to rapidly provide said signal in response to an interruption of receipt of a beam of light that is directed along the beam path by the source means, and each of the indicator flags is operative when in its extended position and while being moved between the source means and the receiver means to interrupt receipt by the receiver means of light directed along the beam path by the source means.

19. The system as in claims 15, 16, 17 or 18 wherein each of the arm means includes a wire-form member having a) a pivot portion that extends along the associated pivot axis, and b) a mounting portion that is spaced to one side of the associated pivot axis, and each of the indicator flags is rigidly connected to its associated mounting portion to form an arm assembly means for pivotal movement about the associated pivot axis to effect movement of the indicator flag of the arm assembly means between its associated nested and extended positions.

20. The system of claim 19 wherein each of the arm assembly means additionally includes counterbalance means for being connected to its associated wire-form member for counterbalancing the arm assembly means such that, when the arm assembly means is oriented to position its associated indicator flag in its associated nested position, any effect that forces which are caused by rotation about the axis of rotation may have that tends to move its associated indicator flag out of its associated nested position will be minimized.

21. The system of claim 20 wherein each of the wire-form members has a portion that extends to one side of its associated pivot axis to interconnect its associated mounting portion with its associated pivot portion, and another portion that extends to substantially an opposite side of its associated pivot axis to connect with and mount the counterbalance means thereon; and, the mass of the counterbalance means is selected such that, when the counterbalance means is connected to the associated wire-form member to form a part of the associated arm assembly means, the mass of such portions of the arm assembly means as extend to said one side of its associated pivot axis is counterbalanced by the mass of such portions of the arm assembly means as extend to said opposite side of its associated pivot axis.

22. The system as in claims 15, 16, 17 or 18 wherein each of the biasing means includes a separate torsion coil spring that has one end region connected to the rotary structure, and another end region connected to its associated indicator flag means.

23. The system of claim 22 wherein each of the separate biasing means includes adjustment means for being adjusted to control the biasing force that is interposed on the associated arm.

24. The system as in claims 15, 16, 17 or 18 additionally includes separate latch means connected to the guide means and being selectively movable between latched and unlatched positions wherein the latch means functions to selectively prevent and permit movement of its associated flag means out of its associated nested position toward its associated extended position.

25. The system of claim 24 wherein each of the latch means includes an elongate latch pin member that is slidably mounted by the guide means for movement between its associated latched and unlatched positions, and detent means is interposed between the latch pin member and its associated guide means to assist in releasably retaining the latch pin member in a selected one of its associated latched and unlatched positions.

26. A method for rapidly sensing the breakage of one or more of a plurality of strands of material that are being fed substantially in unison along an array of separate feed paths that are defined by apparatus that rotates about an imaginary axis of rotation that is located so as to extend substantially centrally among the rotating array of feed paths, comprising the steps of:

a) providing apparatus including rotary means for rotating about an imaginary axis of rotation, and non-rotary means for being positioned adjacent the rotary means during rotation of the rotary means relative to the non-rotary means about the axis of rotation;

b) providing guide means connected to the rotary means for defining reach portions of an array of separate feed paths that are to be followed by a plurality of strands of material, with the guide means including a plurality of individual guides that are arranged in a substantially circular array that extends substantially concentrically about the axis of rotation, and with each of the guides serving to position a reach portion of a separate one of the strands such that the reach portions of the plurality of strands are spaced apart and extend in said substantially circular array;

c) providing strand reach engagement means including a plurality of individual strand engagement members each of which is movably connected to a separate one of the guides, with each of the strand engagement members being movable from a sensing position wherein the strand engagement member engages its associated reach portion of its associated strand, to an indicating position, with the indicating positions extending in a substantially circular array that extends substantially concentrically about the axis of rotation;

d) providing biasing means including a plurality of biasing devices each of which is interposed between a separate one of the guides and its associated strand engagement member for biasing the associated strand engagement member into engagement with the associated reach portion in a direction that, should such reach portion be absent due to breakage of the associated strand has broken, will cause movement of the associated strand engagement member through its sensing position to its indicating position;

e) providing sensing means connected to the non-rotary means and extending adjacent a substantially circular path of movement that is followed by the guides and the strand engagement members as the rotary means rotates about the axis of rotation, with the sensing means including transmitter means and receiver means, with the transmitter means being operable to transmit energy such as electromagnetic radiation along a beam path from the transmitter means to the receiver means, with the receiver means being operative to provide an output signal that is indicative of when an interruption has taken place in the transmission of energy along the beam path, and with the beam path being oriented such that, when all of the strand engagement members are in their sensing positions, the beam path is not interrupted by any of the strand engagement members, however, when at least one of the strand engagement members moves to its associated indicating positions, the beam path is intercepted by portions of the moved strand engagement members whereby the receiver means senses an interruption of transmission of energy along the beam path and provides said output signal as an indication of the breakage of one or more of the strands that are being fed along the feed paths;

f) feeding a plurality of strands of material along said plurality of separate feed paths; and, g) utilizing said sensing means to sense any breakage of one or more of said strands and, in response thereto, to provide said output signal.

* * * * *